US012484669B2

(12) United States Patent
Lang

(10) Patent No.: US 12,484,669 B2
(45) Date of Patent: Dec. 2, 2025

(54) HANDS-FREE CURVED WEATHER SHIELD

(71) Applicant: Anthony Joseph Lang, Quincy, CA (US)

(72) Inventor: Anthony Joseph Lang, Quincy, CA (US)

( * ) Notice: Subject to any disclaimer, the term of this patent is extended or adjusted under 35 U.S.C. 154(b) by 212 days.

(21) Appl. No.: 18/411,886

(22) Filed: Jan. 12, 2024

(65) Prior Publication Data

US 2024/0215695 A1 Jul. 4, 2024

Related U.S. Application Data

(63) Continuation-in-part of application No. 18/147,434, filed on Dec. 28, 2022.

(51) Int. Cl.
*A45B 11/02* (2006.01)
*A45B 23/00* (2006.01)
*A45B 11/00* (2006.01)

(52) U.S. Cl.
CPC ..... *A45B 11/02* (2013.01); *A45B 23/00* (2013.01); *A45B 2011/005* (2013.01); *A45B 2023/0093* (2013.01)

(58) Field of Classification Search
CPC ..... A45B 11/02
See application file for complete search history.

(56) References Cited

U.S. PATENT DOCUMENTS 191,782 A * 6/1877 Smith, Sr. ..... A45B 11/02 135/90
1,347,540 A * 7/1920 Godard ..... A45B 11/02 224/190
5,263,837 A * 11/1993 Dompe ..... A45B 11/02 224/190
5,353,977 A * 10/1994 Schiro, Jr. ..... A45B 11/02 224/189
6,247,482 B1 * 6/2001 Muis ..... A45B 11/02 224/188
6,619,521 B2 * 9/2003 Hadley ..... A45F 3/14 224/637
8,851,343 B1 * 10/2014 Evans ..... A45B 11/02 224/187
9,375,060 B1 * 6/2016 Bagramyan ..... A45B 11/02
9,907,370 B2 * 3/2018 Huddleston ..... A45B 11/02
10,893,729 B2 * 1/2021 Farese ..... A45F 5/1583
11,330,799 B2 * 5/2022 Albakri ..... A01K 13/006
(Continued)

FOREIGN PATENT DOCUMENTS

WO WO-2016118108 A1 * 7/2016 ..... A45B 11/02

*Primary Examiner* — Robert Canfield

(74) *Attorney, Agent, or Firm* — Donald R. Boys; Central Coast Patent Agengy LLC

(57) ABSTRACT

A weather shield apparatus includes a shield holder having a molded body panel with a curved shape providing ends joined to a lengthwise adjustable waist belt having a waist buckle, a support interface attached to a rear surface of the body panel, a support frame adapted to engage and extend upward from the support interface, the support frame having a cushion pad on a side facing the body panel, and a first weather shield assembly comprising a curved shield frame covered in waterproof sheet material, the curved shield frame having connector fittings projecting downward adapted to mate to compatible connector fittings at an uppermost extremity of the support frame.

20 Claims, 23 Drawing Sheets

(56) References Cited

U.S. PATENT DOCUMENTS

| | | | | |
|---|---|---|---|---|
| 2013/0098410 | A1* | 4/2013 | Prasannakumar | A45B 11/00 135/16 |
| 2015/0122862 | A1* | 5/2015 | Guinancio | A45F 3/04 224/637 |
| 2020/0329834 | A1* | 10/2020 | Farese | A45B 25/24 |
| 2021/0093057 | A1* | 4/2021 | Farese | A45F 5/1583 |

* cited by examiner

HANDS-FREE CURVED WEATHER SHIELD

CROSS-REFERENCE TO RELATED APPLICATIONS

The present application is a Continuation-in-Part of co-pending application Ser. No. 18/147,434, filed Dec. 28, 2022. The disclosures of the parent case is incorporated herein at least by reference.

BACKGROUND OF THE INVENTION

1. Field of the Invention

The present invention is in the technical field of apparatus for protecting persons from sun and rain and pertains particularly to an umbrella holder that leaves a user's hands free to perform variable tasks.

2. Description of Related Art

The existence and use of umbrellas for protection from both sun and precipitation is well known in the art. There have also been do-it-yourself and commercially available umbrella holders, but the available holders in the current art leave room for considerable improvement. To the knowledge of the inventor there exists no heavy-duty body-mounted umbrella holder that allows the user complete freedom of the hands and arms.

BRIEF SUMMARY OF THE INVENTION

In an embodiment of the invention a weather shield apparatus is provided, comprising a shield holder having a molded body panel with a curved shape providing ends joined to a lengthwise adjustable waist belt having a waist buckle, a support interface attached to a rear surface of the body panel, a support frame adapted to engage and extend upward from the support interface, the support frame having a cushion pad on a side facing the body panel, and a first weather shield assembly comprising a curved shield frame covered in waterproof sheet material, the curved shield frame having connector fittings projecting downward adapted to mate to compatible connector fittings at an uppermost extremity of the support frame. The apparatus is characterized in that a user is enabled to mount the shield holder around the user's torso, fastened by the waist buckle of the waist belt, such that the support frame extends upward from behind the user with the cushion pad against the user's back, and supports the first weather shield assembly over the user's head, protecting the user from precipitation and sunlight while leaving the user's hands free.

In one embodiment the connector fittings are compatible portions of pipe union fittings. Also, in one embodiment the support interface is a set of two parallel, vertically-oriented tubes each of a first inside diameter, spaced apart by a center-to-center dimension D1 and open at top ends. In one embodiment the support frame is a linear construction of tubes and fittings, having a lower end with two side-by-side tubes having each an outside diameter providing a slip fit to the inside diameter of the vertically-oriented tubes of the support interface, and spaced apart by center-to-center dimension D1, and an upper end with two side-by-side portions of connector fittings spaced apart by the center-to-center dimension D1. In one embodiment of the apparatus the connector fittings are compatible portions of pipe union fittings.

In one embodiment the apparatus further comprises a first shoulder strap including a first adjustment buckle attached to one side of a front region of the molded body panel and ending in a first hook, and a second shoulder strap including a second adjustment buckle attached to an opposite side of the front region of the molded body panel and ending in a second hook, such that the user is enabled to pass the shoulder straps over the shoulders, hook each to a different portion of the support frame, and adjust length of the shoulder straps to pull the support frame with the cushion pad toward the user's back, stabilizing the support frame with the first weather shield assembly deployed over the user's head. Also, in one embodiment the first weather shield assembly curves downward to the rear with portions of a connector fitting on each side facing downward, the weather shield apparatus further comprising a substantially flat second weather shield assembly joined to the first weather shield assembly by compatible portions of connector fitting on each side of an upper end of the second weather shield assembly, such that the second weather shield assembly protects the user from precipitation and sunlight from the rear. In one embodiment the connector fittings are compatible portions of pipe union fittings. In one embodiment the first weather shield assembly further comprises a notch on each side over and to each side of the user's head, affording a space where the user may deploy a vertical pole of a sign while wearing the shield assembly. And in one embodiment the weather shield apparatus further comprises cushioning fabric implemented on an inside area and along edges of the molded body panel.

In another aspect of the invention a method for protecting from precipitation and sunlight while leaving hands free is provided, comprising implementing a weather shield apparatus with a shield holder having a molded body panel with a curved shape providing ends joined to a lengthwise adjustable waist belt having a waist buckle, a support interface attached to a rear surface of the body panel, a support frame adapted to engage and extend upward from the support interface, the support frame having a cushion pad on a side facing the body panel, and a first weather shield assembly comprising a curved shield frame covered in waterproof sheet material, the curved shield frame having connector fittings projecting downward adapted to mate to compatible connector fittings at an uppermost extremity of the support frame, and mounting the shield holder around the user's torso, fastened by the waist buckle of the waist belt, such that the support frame extends upward from behind the user with the cushion pad against the user's back, supporting the first weather shield assembly over the user's head, protecting the user from precipitation and sunlight while leaving the user's hands free.

In one embodiment the method comprises providing the connector fittings as compatible portions of pipe union fittings. In one embodiment the method comprises providing the support interface as a set of two parallel, vertically-oriented tubes each of a first inside diameter, spaced apart by a center-to-center dimension D1 and open at top ends. In one embodiment the method comprises providing the support frame as a linear construction of tubes and fittings, having a lower end with two side-by-side tubes having each an outside diameter providing a slip fit to the inside diameter of the vertically-oriented tubes of the support interface, and spaced apart by center-to-center dimension D1, and an upper end with two side-by-side portions of connector fittings spaced apart by the center-to-center dimension D1. And in one embodiment the method comprises providing the connector fittings as compatible portions of pipe union fittings.

In one embodiment the method further comprises providing a first shoulder strap including a first adjustment buckle attached to one side of a front region of the molded body panel and ending in a first hook, and a second shoulder strap including a second adjustment buckle attached to an opposite side of the front region of the molded body panel and ending in a second hook, such that the user is enabled to pass the shoulder straps over the shoulders, hook each to a different portion of the support frame, and adjust length of the shoulder straps to pull the support frame with the cushion pad toward the user's back, stabilizing the support frame with the first weather shield assembly deployed over the user's head. Also, in one embodiment the method comprises providing the first weather shield assembly as a shield that curves downward to the rear with portions of a connector fitting on each side facing downward, and providing a substantially flat second weather shield assembly joined to the first weather shield assembly by compatible portions of connector fitting on each side of an upper end of the second weather shield assembly, such that the second weather shield assembly protects the user from precipitation and sunlight from the rear.

In one embodiment the method comprises providing a notch in the first weather shield assembly on each side over and to each side of the user's head, affording a space where the user may deploy a vertical pole of a sign while wearing the shield assembly. And in one embodiment the method further comprises placing cushioning fabric on an inside area and along edges of the molded body panel.

DETAILED DESCRIPTION OF THE INVENTION

Figure 1:
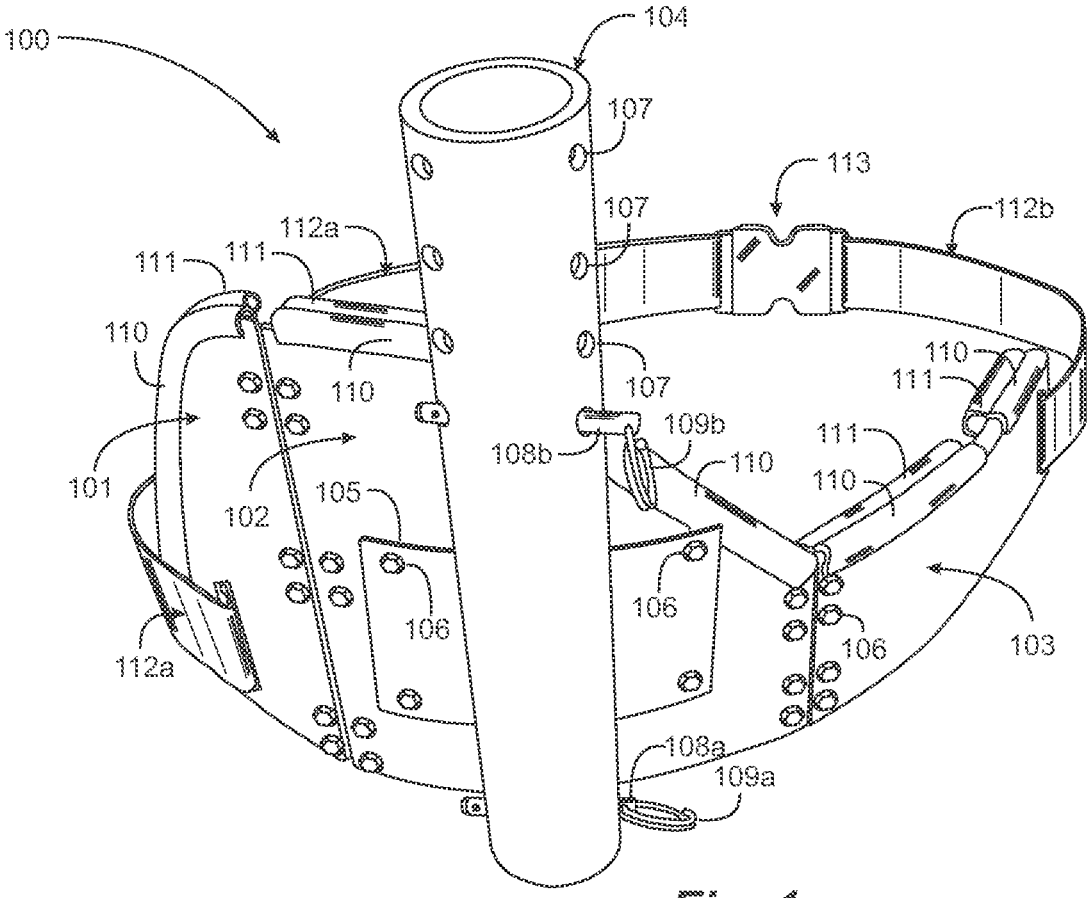
FIG. 1 is a perspective view of a body-mounting umbrella holder according to an embodiment of the present invention.

FIG. 1 is a perspective view of a body-mounting umbrella holder 100 according to an embodiment of the present invention. The umbrella holder 100 in this embodiment comprises a set of three curved, molded plastic body panels 101, 102 and 103 that are joined by hinges that are not seen in FIG. 1 but are evident by sets of fasteners 106 by which the hinges are attached to the body panels. Panel 102 is a back panel to which panel 101 is hinged on one side and panel 103 is hinged on the opposite side. A mounting tube 104 is mounted to back panel 102 by a plate 105 using fasteners 106 and is a holder for a handle for an umbrella. The umbrella is not shown in FIG. 1.

A skilled person will understand that there may be more or fewer hinges and that the hinges may be connected to the body panels other than by conventional fasteners.

A waist strap 112*a* is joined to body panel 101 and a second waist strap 112*b* is joined to body panel 103 such that the set of hinged body panels may be secured to a user's torso with the waist straps circling the torso and joined by a buckle 113. Both waist straps may be adjustable with adjustment buckles to provide for users of differing girth. The waist strap arrangement may be done in different ways, and the straps shown are one example.

In use for holding the umbrella, body panel 102 would be located at the user's back with the handle of the umbrella in the mounting tube, with panels 101 and 103 to each side of the user. Lateral holes through tube 104 near the bottom end of the tube provide for a pin 108*a* with a pull ring 109*a* to serve as a stop for the handle of the umbrella. A second lateral hole with a pin 108*b* and pull ring 109*b* enables the user to restrain the umbrella from lifting out of the mounting tube. Mounting holes 107 spaced along mounting tube 104 allow for umbrellas having different lengths of handles.

The body panels in this example have rubber edgings 110 and rubber-like bumpers 111 to provide comfort for the user. Further, in some embodiments there may be additional adjustable straps and buckles for holding the apparatus to a user's torso.

Figure 2:
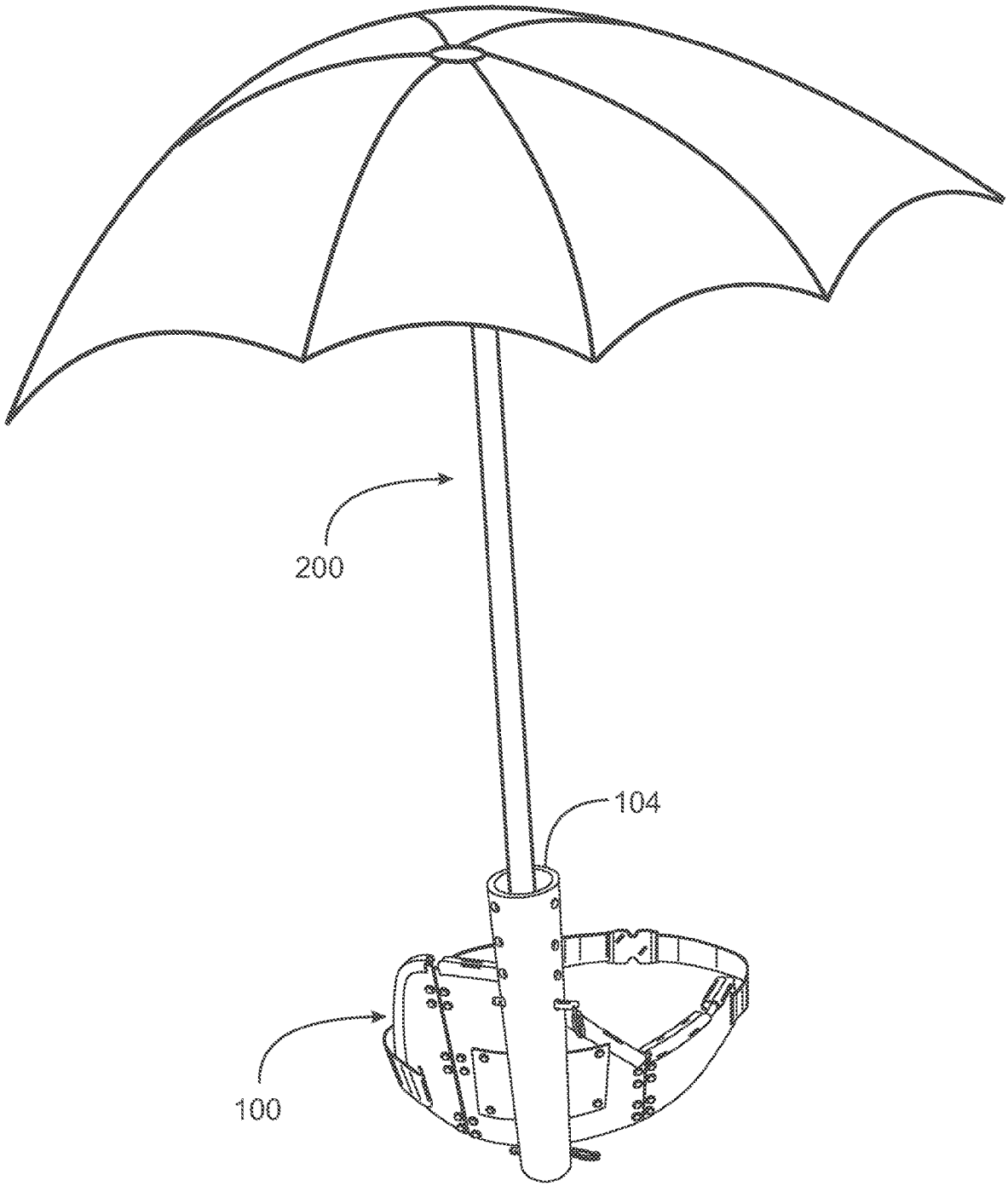
FIG. 2 is a perspective view of the umbrella holder of FIG. 1 with an umbrella engaged.

FIG. 2 shows the umbrella holder 100 with an umbrella 200 engaged in mounting tube 104. The skilled person will recognize that the canopy of umbrella 200 may be larger than shown in FIG. 2, as the available drawing space restricts the size that may be illustrated.

In different embodiments of the invention body panels 101, 102 and 103 may be of different size and thickness, and of somewhat different curvature, to match torso variations among users. For example, a model may be implemented for small-bodied persons, another for medium bodied persons and a third for larger bodied persons. There may well be different ways of providing cushioning effect between the panels and the user's body, other than the rubber-like elements 110 and 111 shown and described above. Panels may be molded in polymers of different colors as well. Further, tube 104 may differ among different models, to accommodate a range of different sorts of umbrellas.

Figure 3:
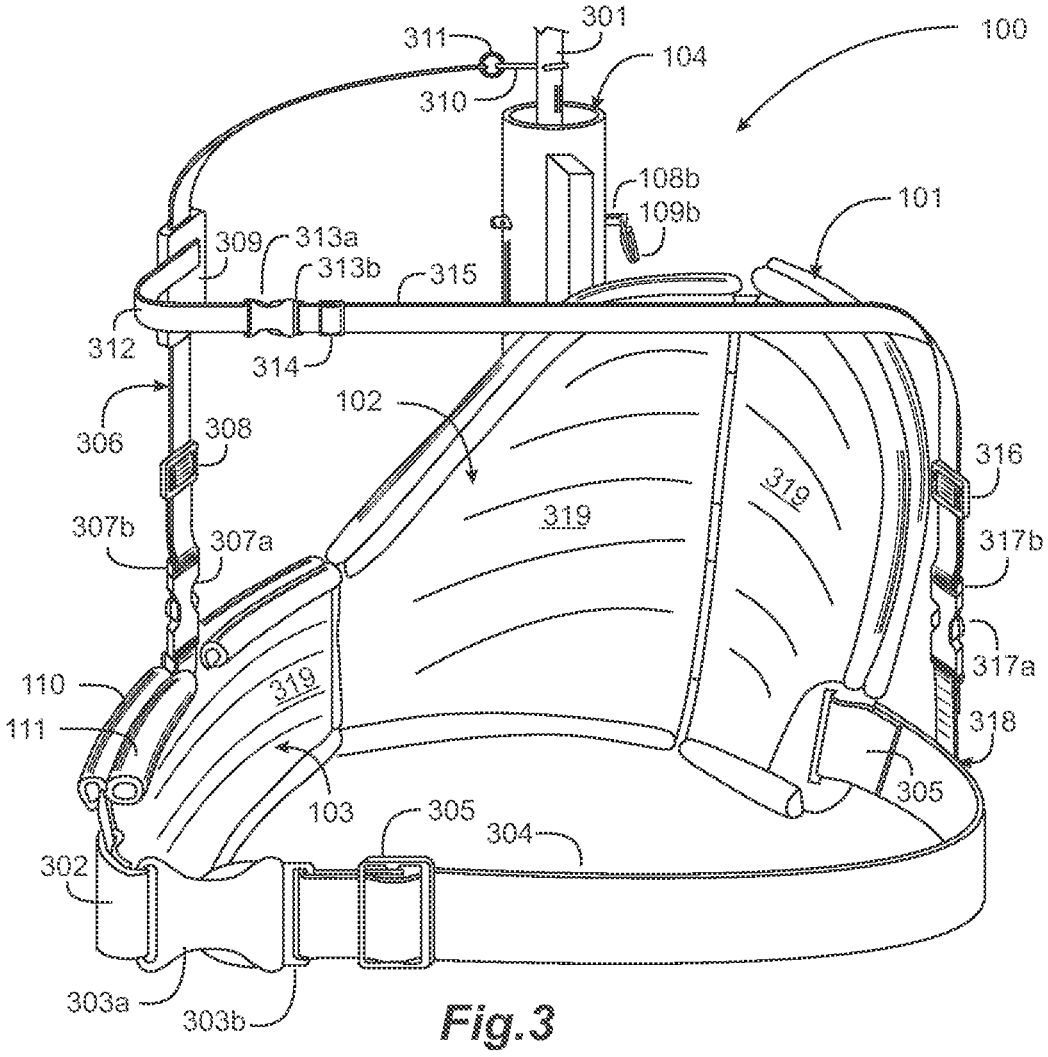
FIG. 3 is a perspective view of the umbrella holder of FIG. 1 from a different viewpoint in an embodiment of the invention.

In embodiments of the invention a strap and buckle system may be employed to firmly engage the umbrella holder to a user's torso, and to enable a firm and comfortable fit. FIG. 3 is a perspective view of an umbrella holder according to an embodiment of the invention viewed from a viewpoint opposite the viewpoint of FIG. 1, illustrating in addition an arrangement of straps and buckles, which is different than the arrangement shown in FIG. 1. In the example of FIG. 3 the body panels have edging 110 and bumpers 111 as in the example of FIG. 1, and additionally the inside of the body panels are covered with a padded fabric material 319 for comfort for the user. The body panels are hinged as described previously for the example of FIG. 1, but the hinges may be different in style and number and location.

In the example of FIG. 3 a buckle apparatus for a waist strap comprises two parts 303*a* and 303*b*. Part 303*a* is anchored by a strap 302 which passes through a slot in body panel 103 and is fastened to itself by such as adhesive or stitching. Part 303*b* snaps into part 303*a* and has a slot through which a long waist strap 304 passes, and after passing through the slot is anchored to a middle rib of an adjustment buckle 305. Strap 304 passes also through opening is buckle 305 and over the middle rib. The arrangement enables a user to adjust the overall effective length of strap 304 to help provide a firm and stable mounting of the umbrella holder to the user's torso. Strap 304 is anchored at the opposite end through a slot in body panel 101.

About midway along a top edge of body panel 103 a snap-in release buckle having two parts 307*a* and 307*b* is anchored by a short strap length. Snap in part 307*b* has slot through which strap 306 passes and is fastened back to an adjustment buckle 308. This apparatus and operation is the same as described above for buckle 303*a* and 303*b* with adjustment buckle 305. The size and models are different for the different size straps. Strap 306 has a shoulder cushion 309 attached in this example and extends on to a ring 311 that holds a hook 310. In use a user, after donning the holder and closing the waist straps, rotates the umbrella tube to the back, grasps the hook and attaches same to the handle 301 of the umbrella, which is held in the tube 104. This operation, by also adjusting length of strap 306 by buckle 308, secures the umbrella firmly to the user's torso at the back.

In this example an auxiliary strap 312 is secured to cushion 309 by stitching or adhesive and extends to a snap-in release buckle consisting of parts 313*a* and 313*b*. A longer strap 315 passes through an adjustment buckle 314 and through part 313*b* back to anchoring at a middle rib of buckle 314. Strap 315 continues across a user's chest to and through another adjustment buckle 316 and though a slot in a part 317*b* of yet another snap-in release buckle, and back to anchor to a middle rib of adjustment buckle 316. Part 317*a* of the snap-in buckle is secured to waist strap 304 by sewing or adhesive near to body panel 101.

In summary, the strap and buckle arrangement illustrated in the example of FIG. 3 enables a user to very securely mount the umbrella holder to the user's torso with a variety of ways to configure and adjust the straps for the individual user's choice and comfort.

Figure 4:
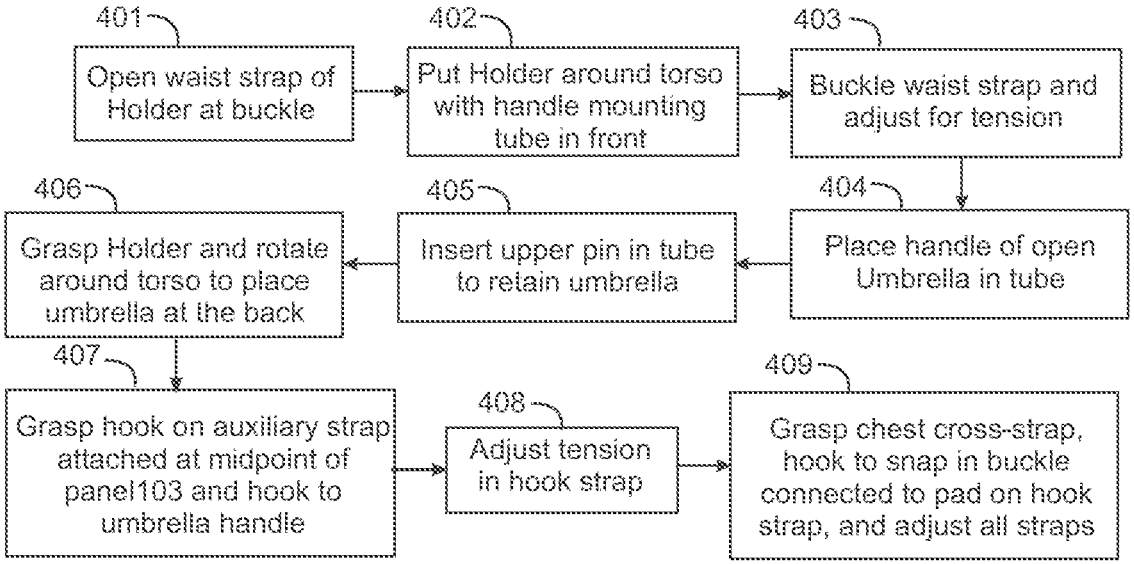
FIG. 4 is a flow diagram of a process in an embodiment of the invention.

FIG. 4 is a flow diagram depicting steps in a process of donning an umbrella holder of an embodiment of the invention and deploying the umbrella. At step 401 a user opens the waist straps of the holder at the buckle, with the top lateral pin removed. At step 402 the user puts the holder around the torso with the handle mounting tube in front. At step 403 the waist straps are buckles and adjusted for tension, leaving a bit loose. At step 404 the umbrella is opened, and the handle of the umbrella is engaged in the tube. At step 405 the upper lateral pin is inserted in the upper lateral hole of the tube to retain the umbrella in the tube. At step 406 the user grasps the holder and rotates the holder around the torso, placing the tube with the umbrella at the back of the user. At step 407 the user grasps the hook on the auxiliary strap attached to the midpoint of body panel 103 and hooks to the umbrella handle over the user's shoulder. With the umbrella in this position the user's hands and arms are completely free. At step 408 the user adjusts the tension on the hook strap. At step 409 the user grasps the chest cross-strap, snaps in the snap-in buckle near the pad on the hook strap, and the user adjusts all straps for comfort. The skilled person will understand that the steps may have a different order.

An important purpose of apparatus in embodiments of the invention is to enable persons to operate hands free in a raining or snowing environment. This advantage is particularly useful for electricians, for example, who may have to work outside in inclement weather. Also useful for farmers and many other working people and may well be useful for persons attending outdoor events, like football and soccer games.

In a further enhancement of the invention unique attachment apparatus is provided whereby the mounting tube for the umbrella and other apparatus may be made in a manner that the apparatus attached may be quickly and securely attached and may be removed quickly and easily as well.

Figure 5:
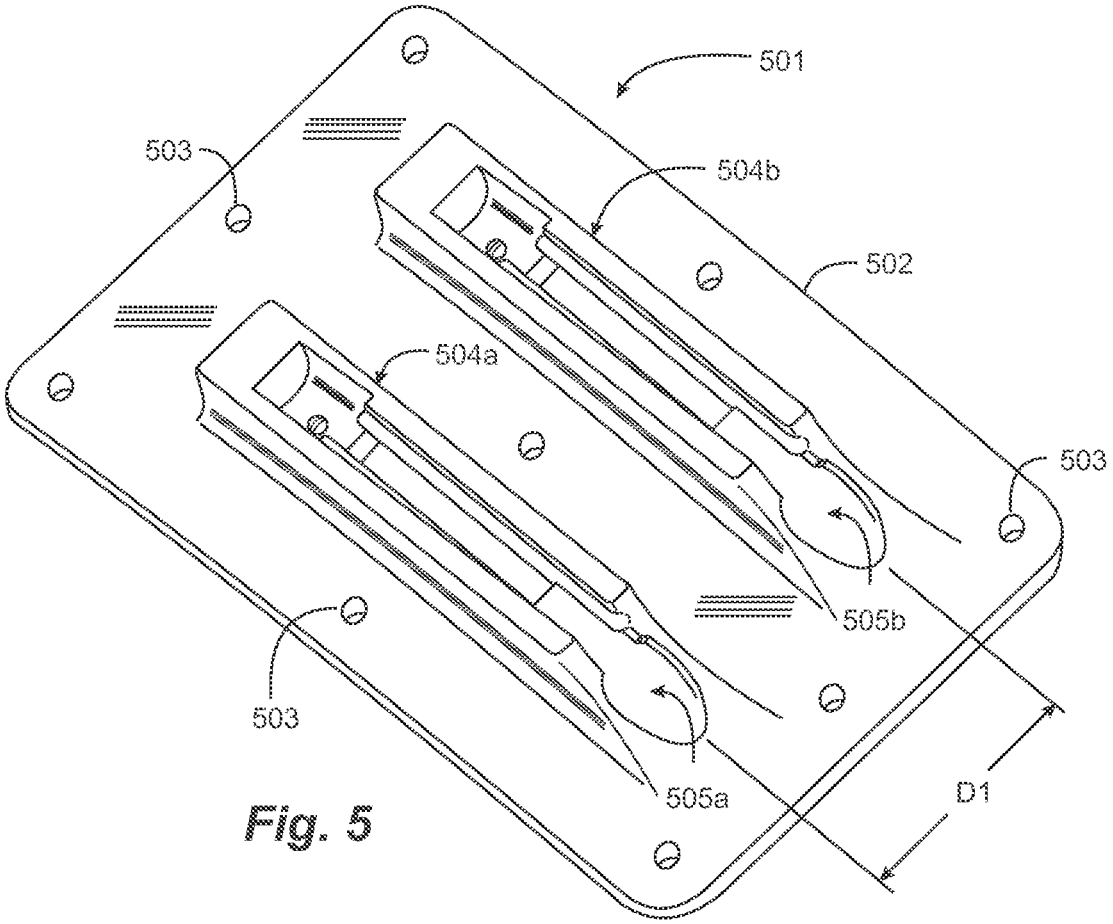
FIG. 5 shows an attachment unit with twin channels in an embodiment of the invention.

FIG. 5 is a perspective view of a female quick attachment unit 501 used in what the inventor terms a TwinRail locking system. Unit 501 comprises two identical polymer molded raised channels 504*a* and 504*b* spaced apart by dimension D1 on a backing plate 502. Channels 504*a* and 504*b* are parallel to one another and to a long edge of plate 502. Channels 504*a* and 504*b* are preferably molded onto backing plate 502 in an injection molding process, but this is not a limitation in the invention. Plate 502 has a pattern of through holes 503, nine in this example, that serve to fasten the plate to one of the body panels 101, 102 or 103 of the umbrella holder 100.

Figure 6:
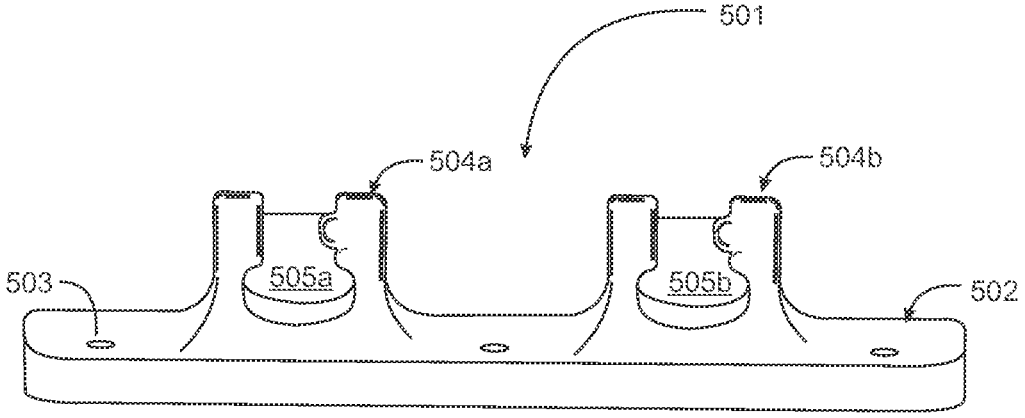
FIG. 6 illustrates the unit of FIG. 5 from a different viewpoint.

FIG. 6 is an elevation view of attachment unit 501 from the open end of the channels looking into open ends 505*a* and 505*b* of channels 504*a* and 504*b*. Plate 502 is curved to match the curvature of one of body plates 101, 102 or 103 but channels 504*a* and 504*b* may be straight and may not match the curvature of the plate. It may be seen in FIG. 5 that the inner shape of the channels is wider at the bottom and more narrow at the top.

Figure 7:
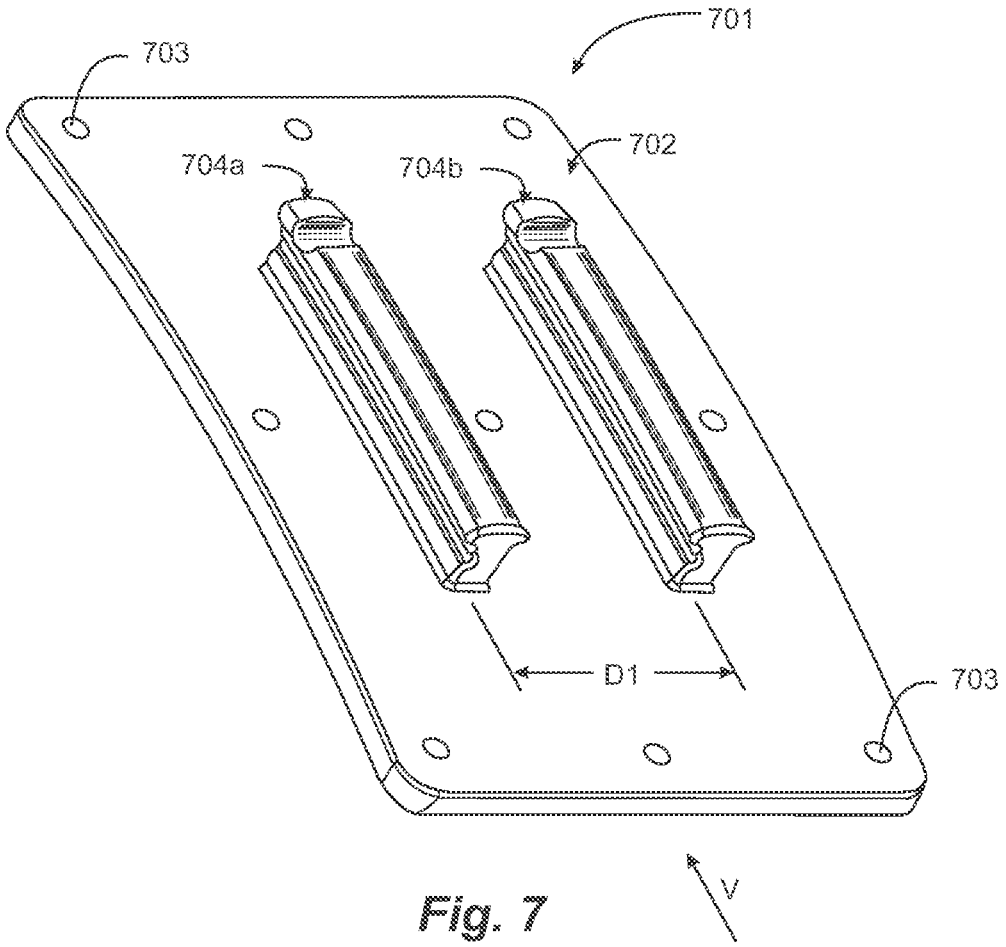
FIG. 7 shows an attachment unit with rails in an embodiment of the invention.

FIG. 7 is a perspective view of an attachment unit 701 which is meant to mate with attachment unit 501 to join apparatus to one of the body plates 101, 102 or 103. Attachment unit 701 has two raised rails 704*a* and 704*b* spaced apart by distance D1 on a mounting plate 702 that may be curved like plate 502. Rails 704*a* and 704*b* have a cross section shape that is molded to be conformal to the internal shape of channels 505*a* and 505*b*.

Figure 8:
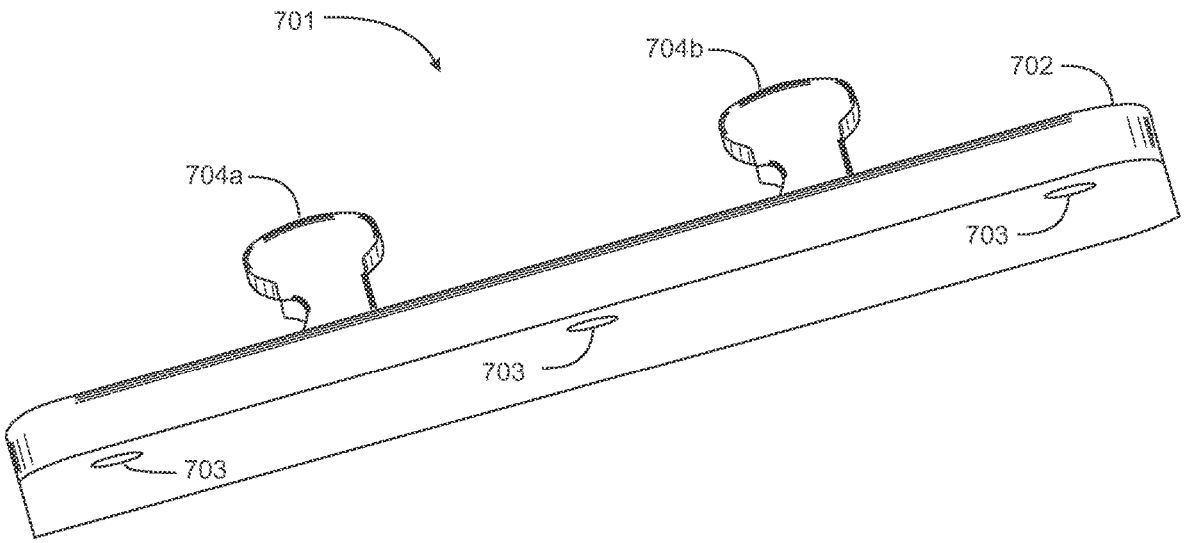
FIG. 8 shows the unit of FIG. 7 from a different viewpoint.

FIG. 8 is a view of unit 701 in view direction of arrow V, to clearly show the cross-section shape of the rails, which is the shape at the ends of the rails. It will be clear to the skilled person from the views of FIGS. 5, 6, 7, and 8 that the rails of unit 701 may slide into and engage the channels 504*a* and 504*b*. It is necessary, of course to invert one of the units so the channels and the rails are facing.

Figure 9:
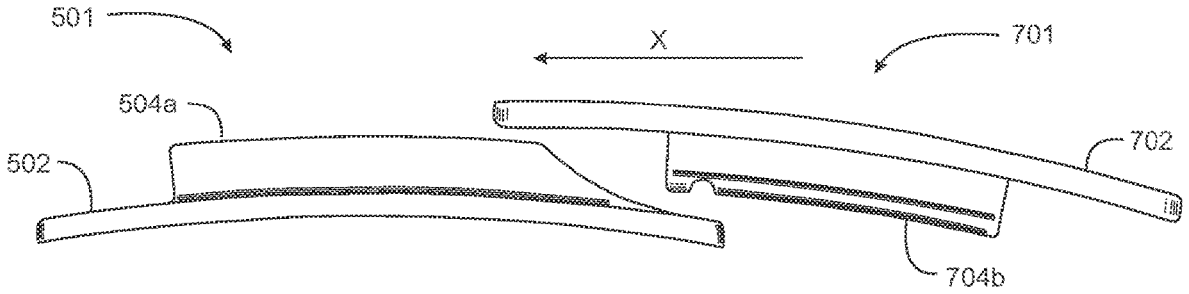
FIG. 9 shows a channel unit and a rail unit in positions to be engaged.
Figure 10:
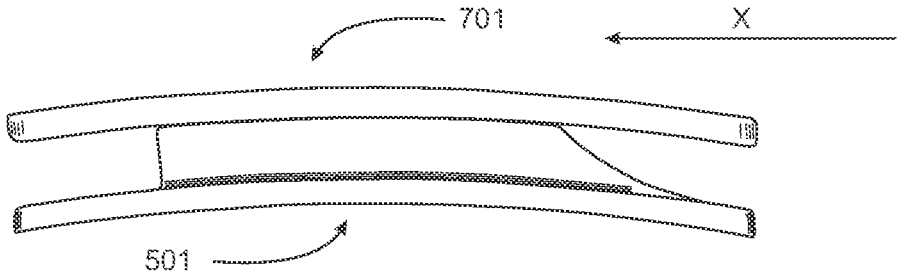
FIG. 10 shows the channel unit and the rail unit of FIG. 9 fully engaged in an embodiment of the invention.

FIG. 9 shows a channel unit 401 and a rail unit 601 in positions to be engaged. It may be seen that the rail unit 701 has been inverted so the rails face toward the channels of the channel unit. To engage the attachment units a user would hold channel unit 501 steady and move rail unit 701 in the direction of arrow X, guiding the rails to enter the channels and continuing the movement until the twin rails are fully engaged in the twin channels. FIG. 10 shows the engagement complete, with the units fully engaged.

A primary purpose of the twin rail attachment system in embodiments of the invention is to attach and detach apparatus to the umbrella holder 100, specifically to one or another of the body panels 101, 102 or 103 of the umbrella holder.

Figure 11:
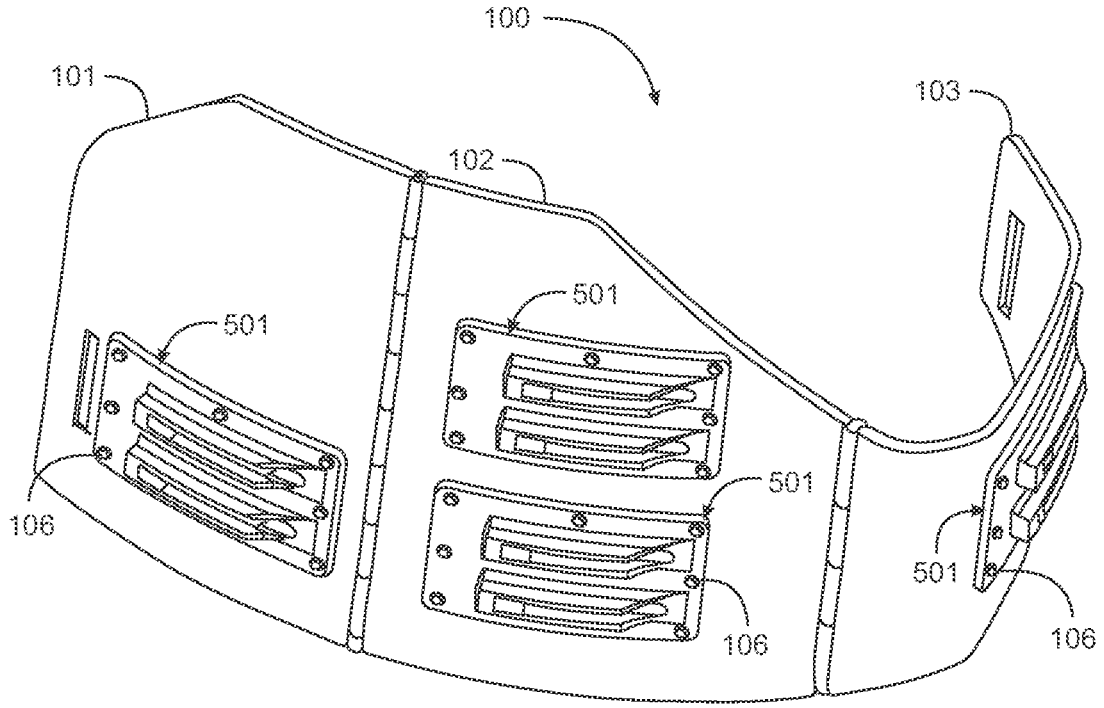
FIG. 11 illustrates the three hinged body panels with attachment plates fastened to each of the body panels in an embodiment of the invention.

FIG. 11 illustrates body panels 101, 102 and 103 of umbrella holder 100 hinged together without the mounting tube for the umbrella handle and without straps, with four TwinRail channel attachment units 501 mounted to the body panels. Two such units are mounted to back panel 102 with one above the other, and one each to each side panel 101 and 103. An important purpose of the twin rail attachment units fastened to the body panels is to provide a system of quickly and easily attaching and removing the umbrella mounting tube to panel 102, and other elements to be mounted to the side panels 101 and 103.

Referring now back to FIG. 1, mounting tube 104 for the umbrella handle is shown joined to a plate 105 which is attached to body panel 102 by fasteners 106. In an alternative embodiment the TwinRail system is used to attach the mounting tube to body panel 102 in a manner that the mounting tube may be engaged and disengaged quickly and easily, such that tubes of different design and use may be substituted at need.

Figure 12:
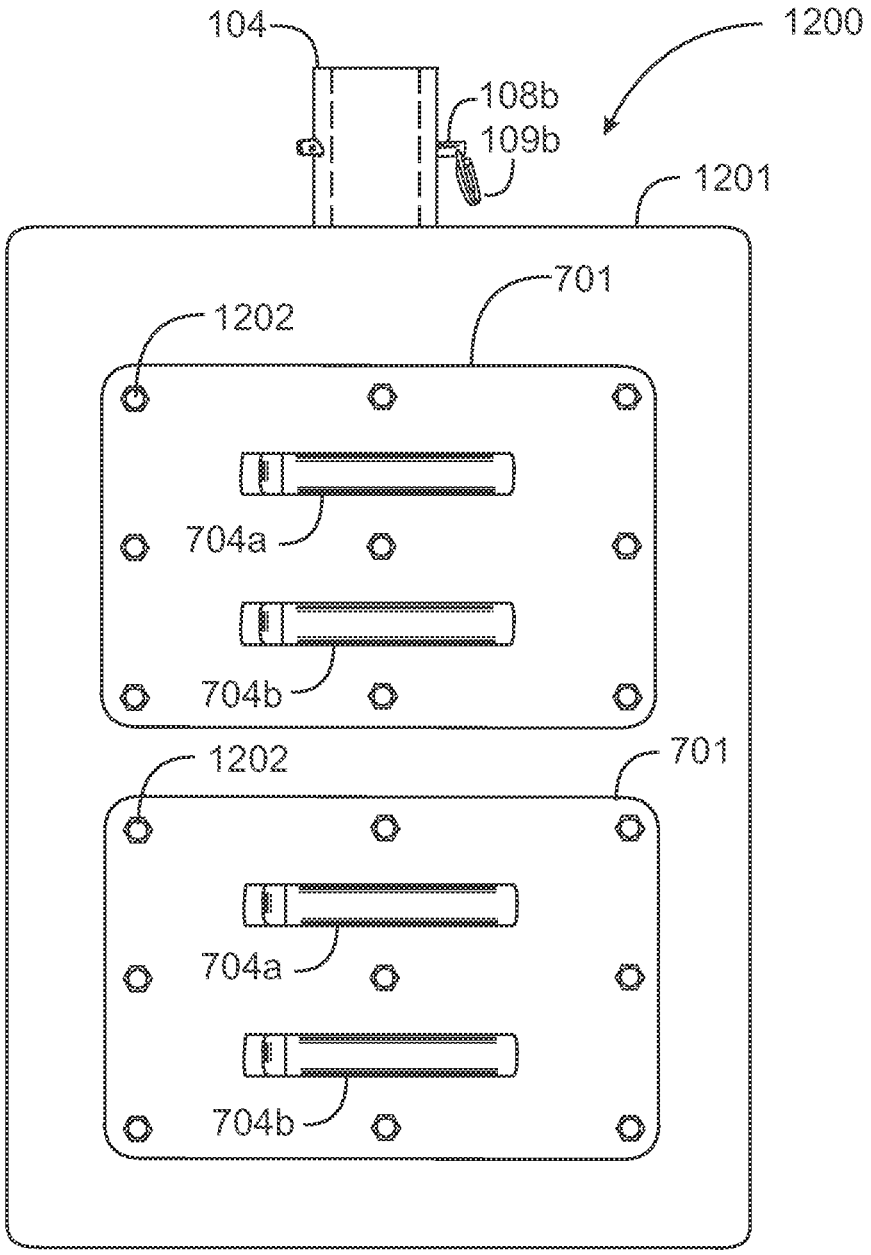
FIG. 12 is a perspective view of a mounting tube joined to a plate which has two TwinRail attachment units joined thereto in an embodiment of the invention.

FIG. 12 is a perspective view of a mounting tube assembly 1200 comprising a mounting tube 104 joined to a plate 1201 which has two TwinRail attachment units 701 joined thereto by fasteners 1202. Attachment units 701 have each two male rails 704*a* and 704*b* that are compatible for engaging channels 504*a* and 504*b* of TwinRail attachment units 501.

Referring now to FIG. 11 the apparatus assembly of FIG. 12 may be reversed and joined by the male attachment units 701 to the female attachment units 501 that are attached to body plate 102, by engaging the ends of the male rails with the female channels and sliding in laterally until the attachment units are fully engaged, at which point there is a noticeable latching action. The mounting tube is thus mounted to the middle back body plate and may be easily disengaged for service or for joining a different mounting tube to the umbrella holder.

Figure 13:
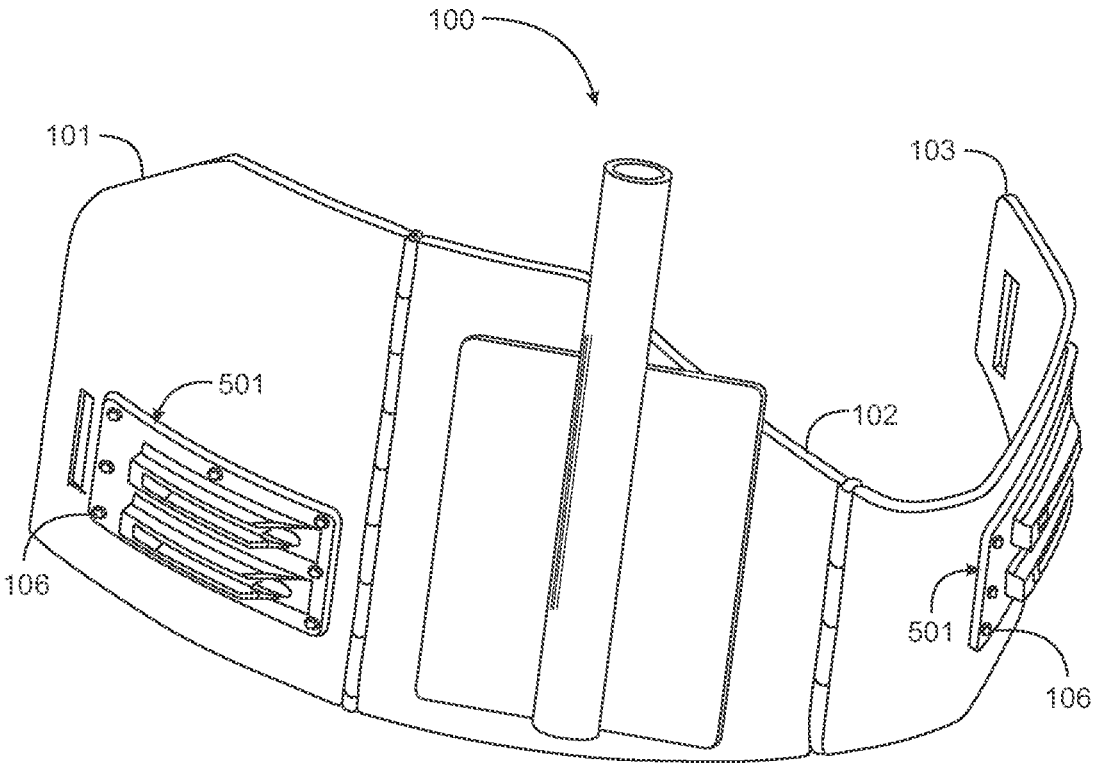
FIG. 13 illustrates the assembly of FIG. 12 joined to the back body plate to mount the tube.

FIG. 13 illustrates the assembly 1200 of FIG. 12 joined to the back body plate 102 to mount the tube 104. The pins in the tube are not illustrated.

Figure 14A:
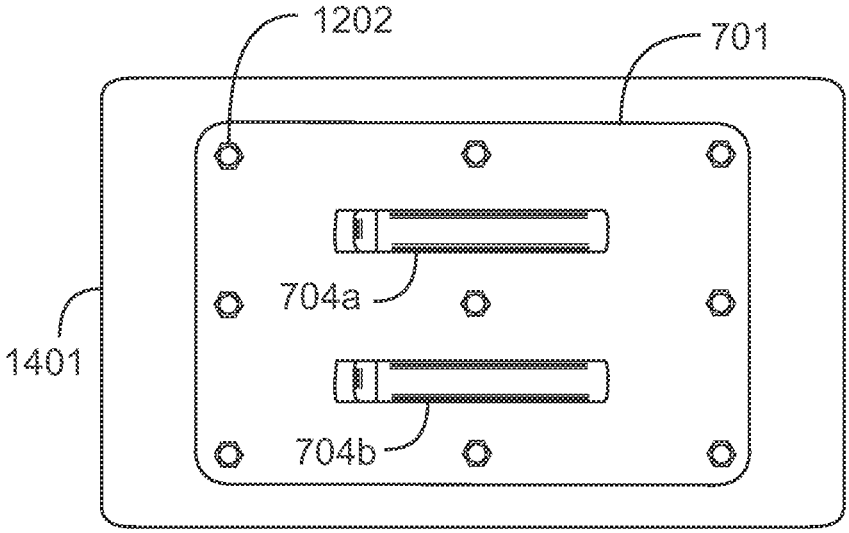
FIG. 14A sis a back view of mounting plate with a single TwinRail unit.
Figure 14B:
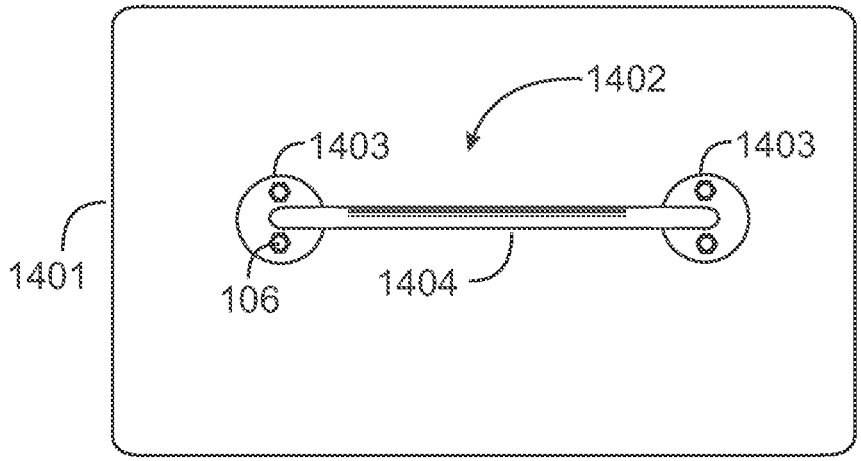
FIG. 14B shows the assembly of FIG. 14A from the opposite side.

FIGS. 14*a* and 14*b* illustrate a mounting plate 1401 with a single TwinRail attachment unit 701 with rails 704*a* and 704*b* mounted to one side of plate 1401 by fasteners 1202. FIG. 14*b* shows in this example a simple bar assembly 1402 with a bar 1404 mounted between two end mounts 1403 that join the bar to plate 1401 by fasteners 106. Bar 1404 may be used, for example, to hang a hammer, as is done on tool belts, or to carry other tools.

Figure 15:
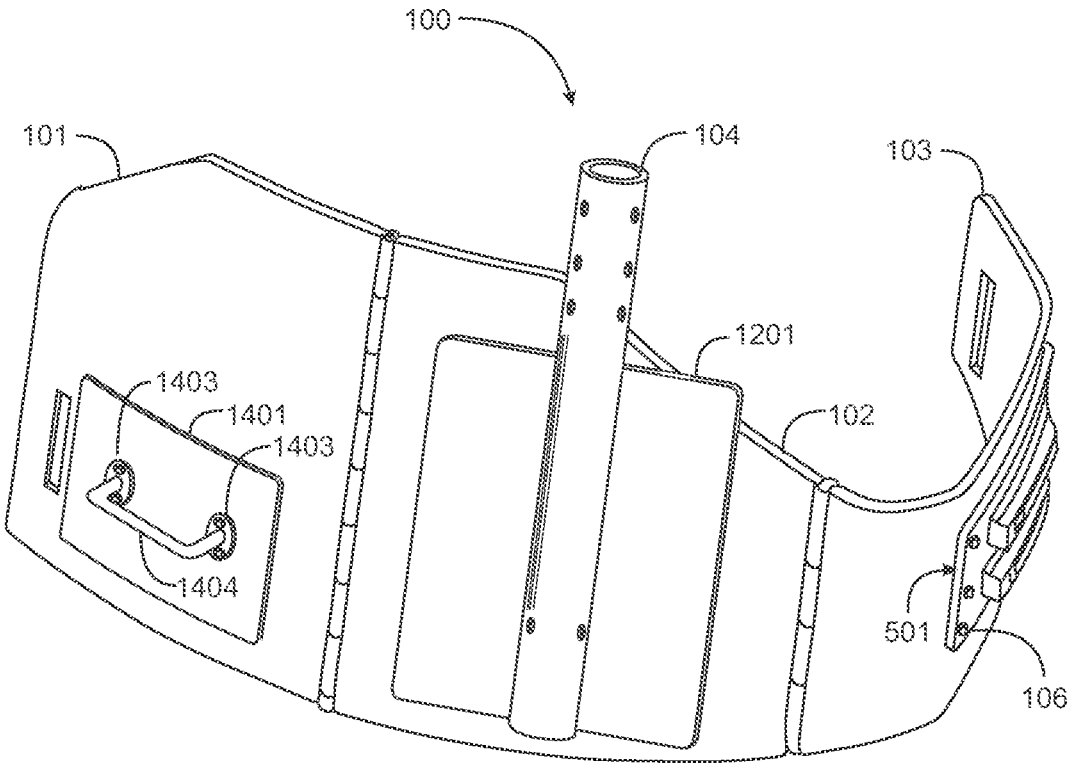
FIG. 15 shows the umbrella holder assembly with a mounting plate with a bar joined to a female attachment unit on body plate 101.

FIG. 15 shows the umbrella holder assembly of FIG. 14 with a mounting plate 1401 with bar 1404 joined to the female attachment unit 501 on body plate 101. The female attachment plate or the male attachment plate cannot be seen in FIG. 15 as both are between plate 1401 and body plate 101.

In another example mounting plate 1401 may be engaged with attachment unit 501 on body plate 103 on the other side of assembly 101 or one may be engaged to both body plate 101 and 103. Similar mounting plates may be configured for different functions, such as pockets to carry other tools or fasteners for example. There are many possibilities enabled by the use of the TwinRail attachment plates, The inventor, in using the apparatus of FIG. 2, described in enabling detail above, has determined that there may be certain situations and circumstances wherein that apparatus may not afford adequate protection. The apparatus in embodiments of the invention is provided for protection of a user from precipitation and from exposure to sunlight. In some circumstances the direction of the sun's rays may be such that the user's body is not fully protected. Accordingly, the inventor has developed a new version of a hands-free apparatus that enables the user to add or subtract sections to or from a compound shield to provide desired protection. The new version has a body mounted holder similar to holder 100 of FIG. 1, but does not hold an umbrella, but instead holds the compound shield with removable and replaceable sections.

Figure 16:
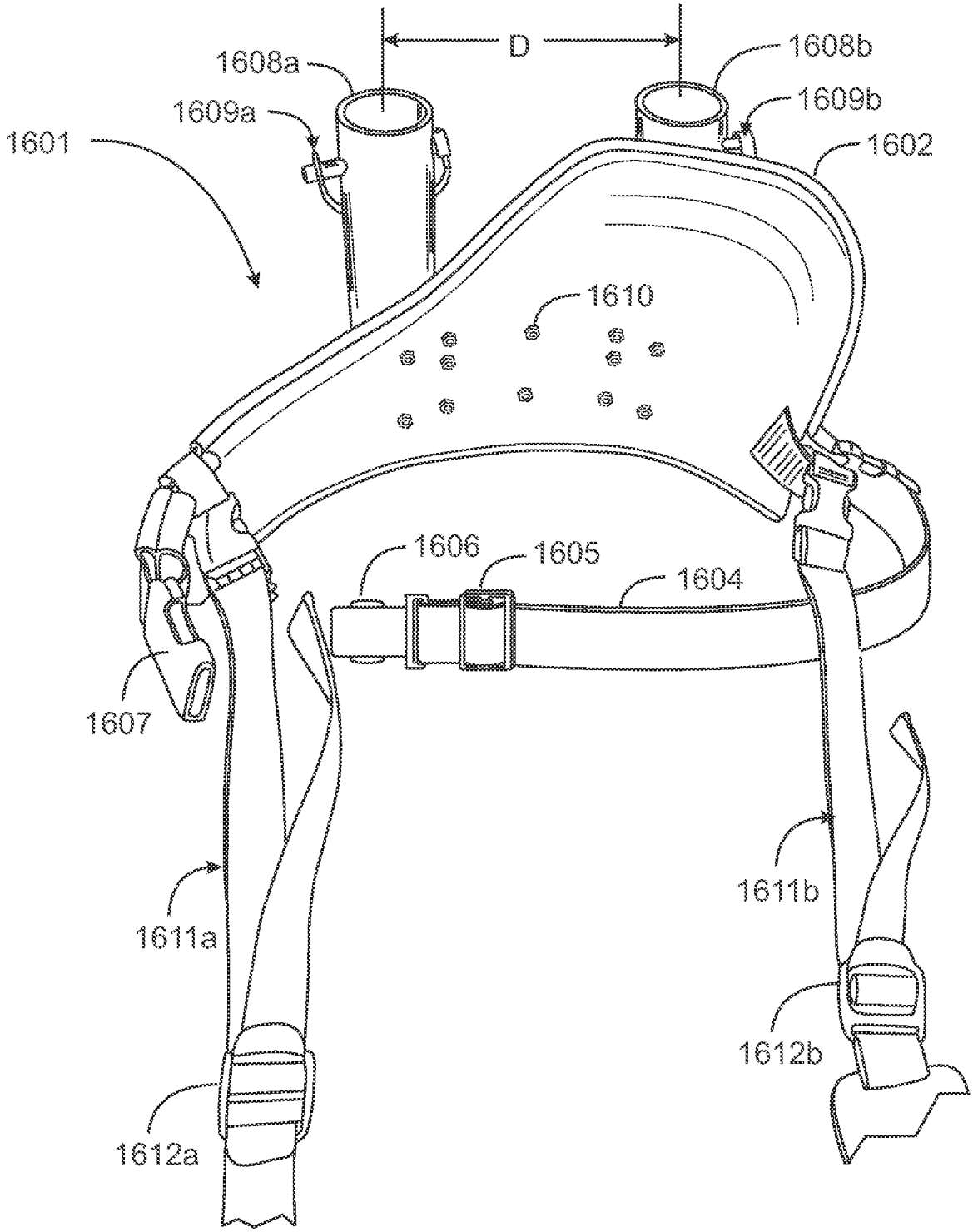
FIG. 16 is a perspective view of a body interface structure for a body-mounting umbrella holder according to an alternative embodiment of the invention.

FIG. 16 is a perspective view of a body-mounted shield holder 1601 according to an embodiment of the invention. Shield holder 1601 comprises a semi-rigid form 1602 shaped to conform to a user's back and sides. Form 1602 may comprise hinged panels as described above for holder 100 or may be a one-piece structure with a curved aspect shaped to a user's body, and flexible enough to engage larger and smaller users. Form 1602 in this example has rubber-like edging and bumpers as described above for holder 100.

A waist belt 1604 attaches to form 1602 on one side, has an adjustment buckle 1605 enabling the user to adjust the length of the waist belt, and a snap-in element 1606 at an end away from the form, adapted to engage a snap-in buckle element 1607 attached to form 1602, such that a user may adjust the length of the waist belt, don the form, and snap elements 1607 and 1606 together engaging the form securely to the user's torso.

There are two strap assemblies 1611*a* and 1611*b* with adjustment buckles 1612*a* and 1612*b* respectively attached to form 1602 at opposite ends of the form. These straps are adapted to enable the user to firmly retain a frame assembly not seen in FIG. 16 that is illustrated and described in enabling detail below.

Two vertically-oriented tubes 1608*a* and 1608*b* are attached to a rear area of form 1602 separated by dimension D1 to hold the frame assembly introduced above, but not shown in FIG. 16. Each of tubes 1608*a* and 1608*b* has a locking mechanism 1609*a* and 1609*b* respectively for retaining the frame assembly in the tubes. Fasteners represented by fastener 1610 hold a plate on the rear of form 1603 that attaches the vertically-oriented tubes to form 1603.

Figure 17:
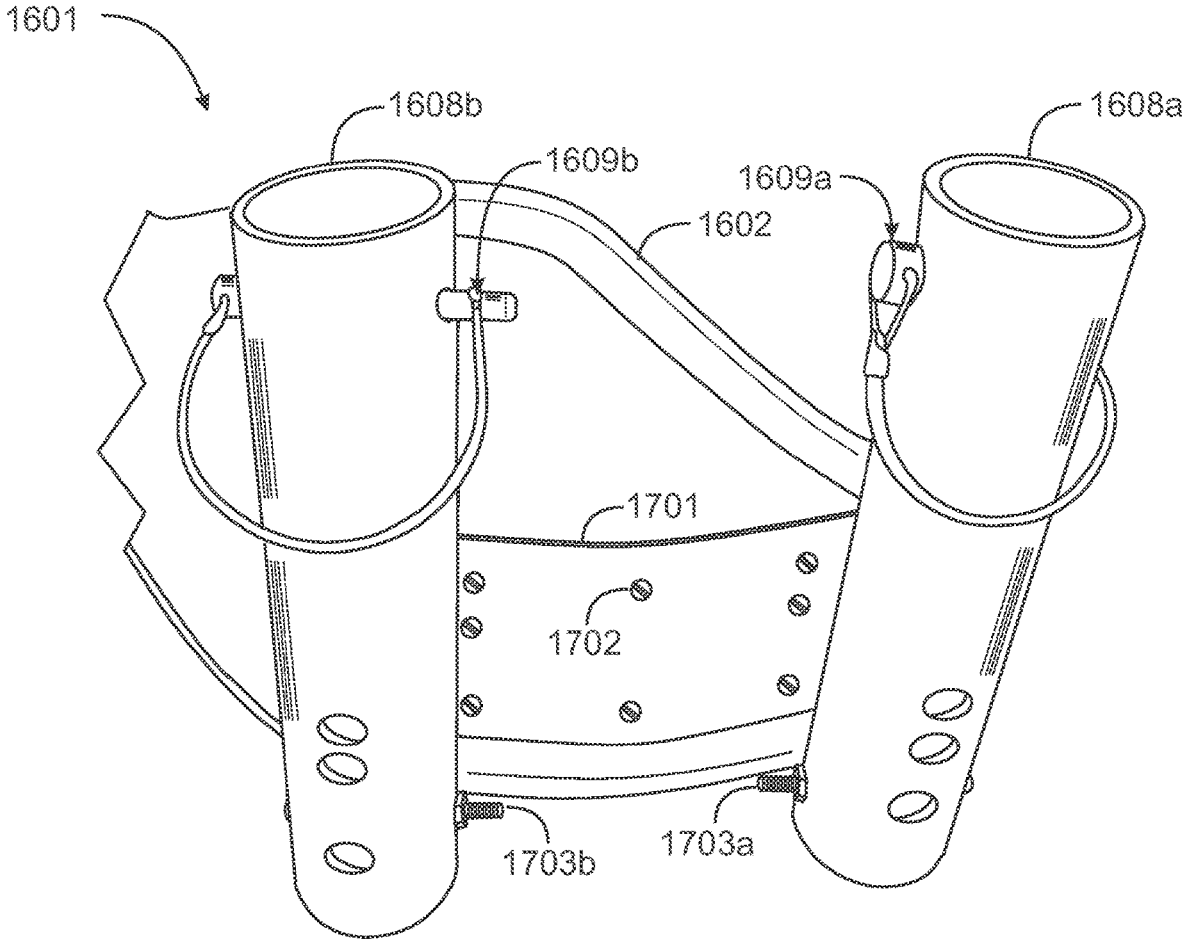
FIG. 17 is a view of the body interface structure of FIG. 16 from a different viewpoint.

FIG. 17 is a rear view of form 1602 showing a portion of form 1602 with tubes 1608*a* and 1608*b* mounted by a metal plate 1701 to form 1602 using bolts represented by bolt 1702 engaging nuts 1610 (FIG. 16). Through bolts and nuts 1703*a* and 1703*b* provide a lower constraint for the frame assembly that is carried in tubes 1608*a* and 1608*b*. Locking mechanisms 1609*a* and 1609*b* are illustrated engaged to the tubes.

Figure 18A:
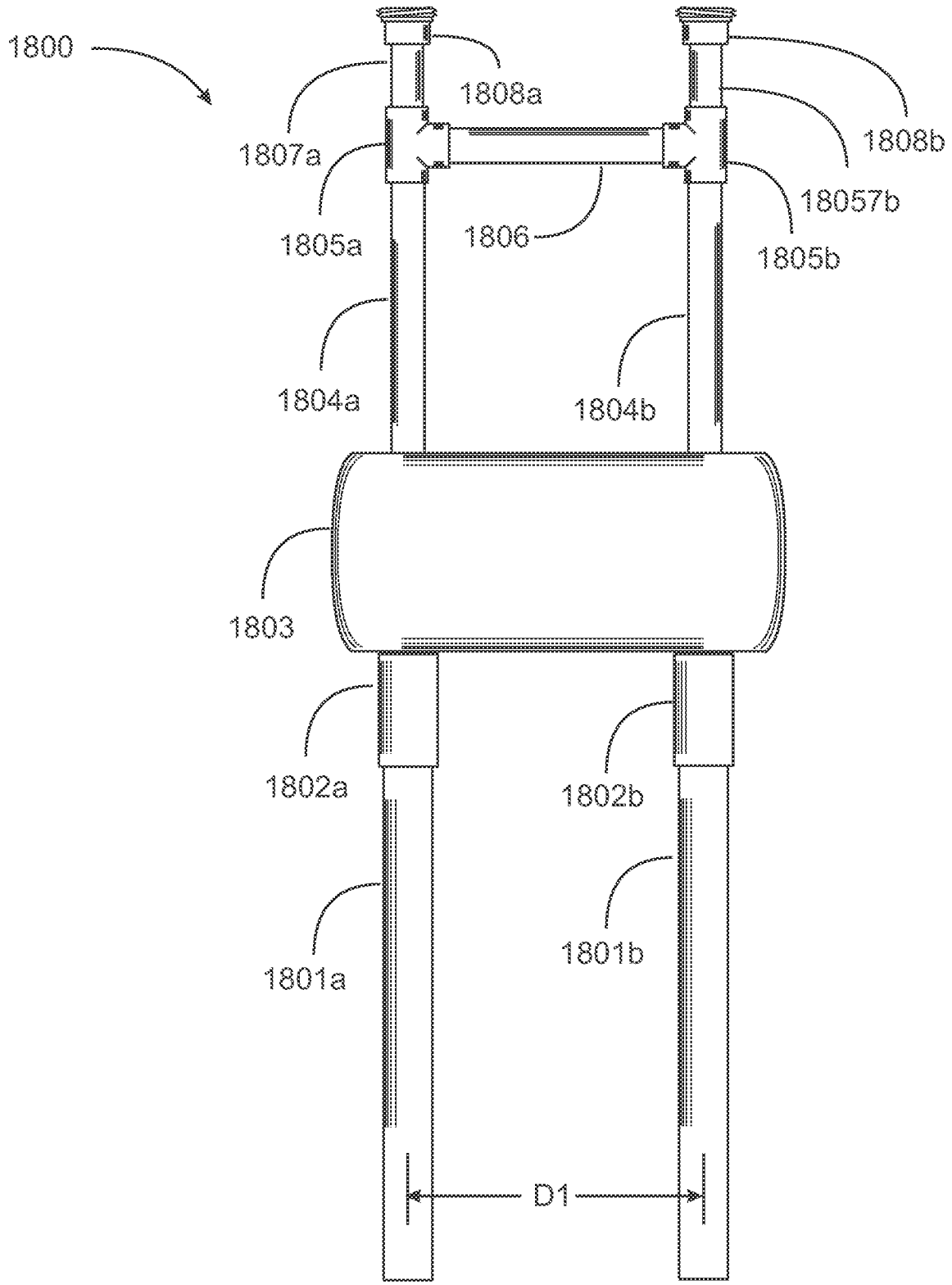
FIG. 18A is a front elevation view of a support frame for a shield assembly in an embodiment of the invention.

FIG. 18A is a front elevation view of a support frame 1800 for a shield assembly in an embodiment of the invention. Support frame 1800 comprises two plastic tubes 1801*a* and 1801*b* leading respectively to two union fittings 1802*a* and 1802*b* that join to smaller diameter tubes 1804*a* and 1804*b* respectively. Tubes 1804*a* and 1804*b* are joined each to a side outlet tee fitting 1805*a* and 1805*b*, which are joined further to two tubes 1807*a* and 1807*b* leading to portions of universal joints 1808*a* and 1808*b*. The side outlets of tees 1805*a* and 1805*b* are joined by a length of tubing 1806 that provides widthwise stability. Tubes and fittings are joined by adhesive.

A cushion pad 1803 is attached across tubes 1804*a* and 1804*b*, to contact a user's back in use and provides further widthwise stability. The center-to-center distance between the vertical tubes 1801*a* abd 1801*b* is D1, as these tubes slide into tubes 1608*a* and 1608*b* attached to the form-fitting shield holder 1601.

Figure 18B:
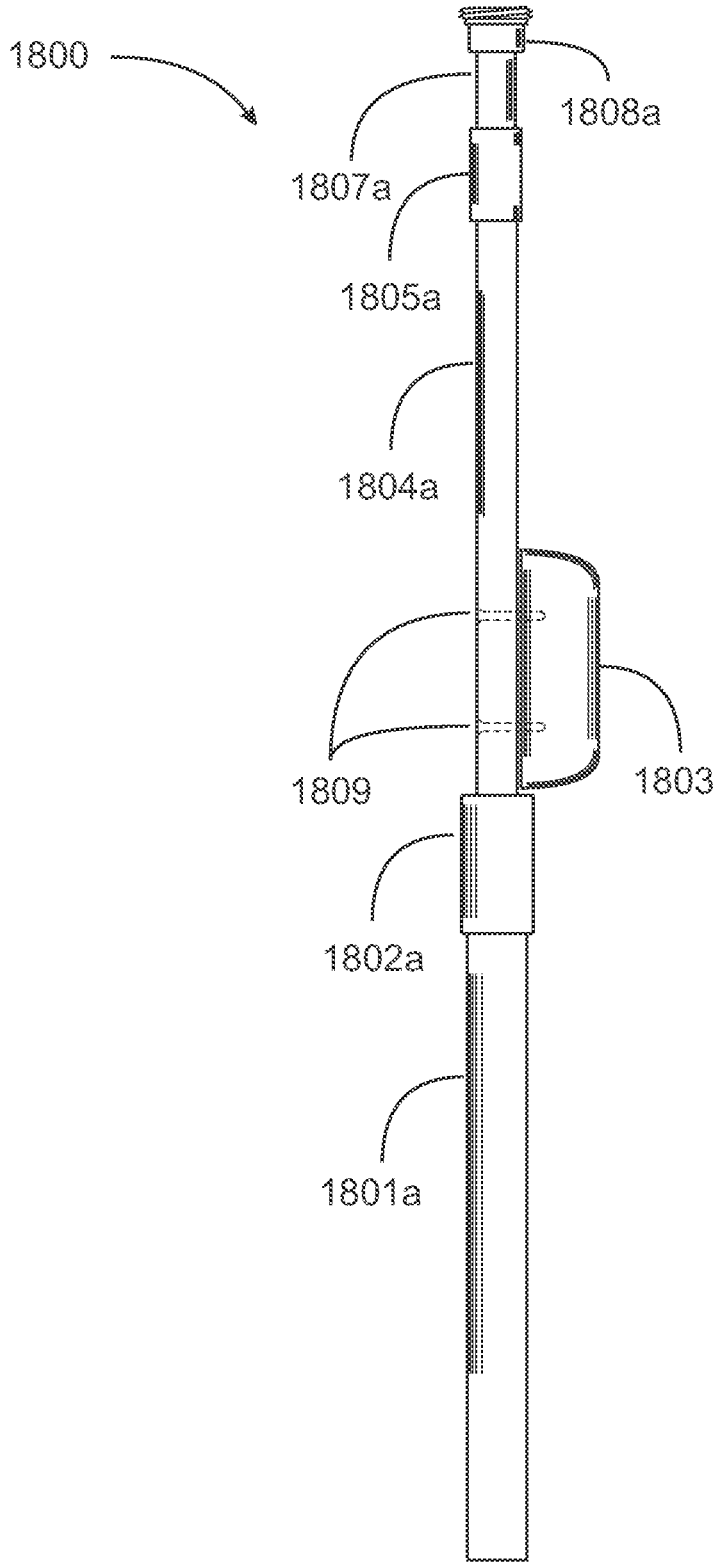
FIG. 18B is a side elevation view of the support frame of FIG. 18A.

FIG. 18B is a side elevation view of the support frame 1801 of FIG. 18A. The tubing elements on one side, labeled "a" are seen in this side view and cushion pad 1803 is seen in side view attached to tubes 1804*a* and 1804*b* by conventional screws 1809 through the tubes and into a wooden or plastic back panel in cushion pad 1803.

Figure 19A:
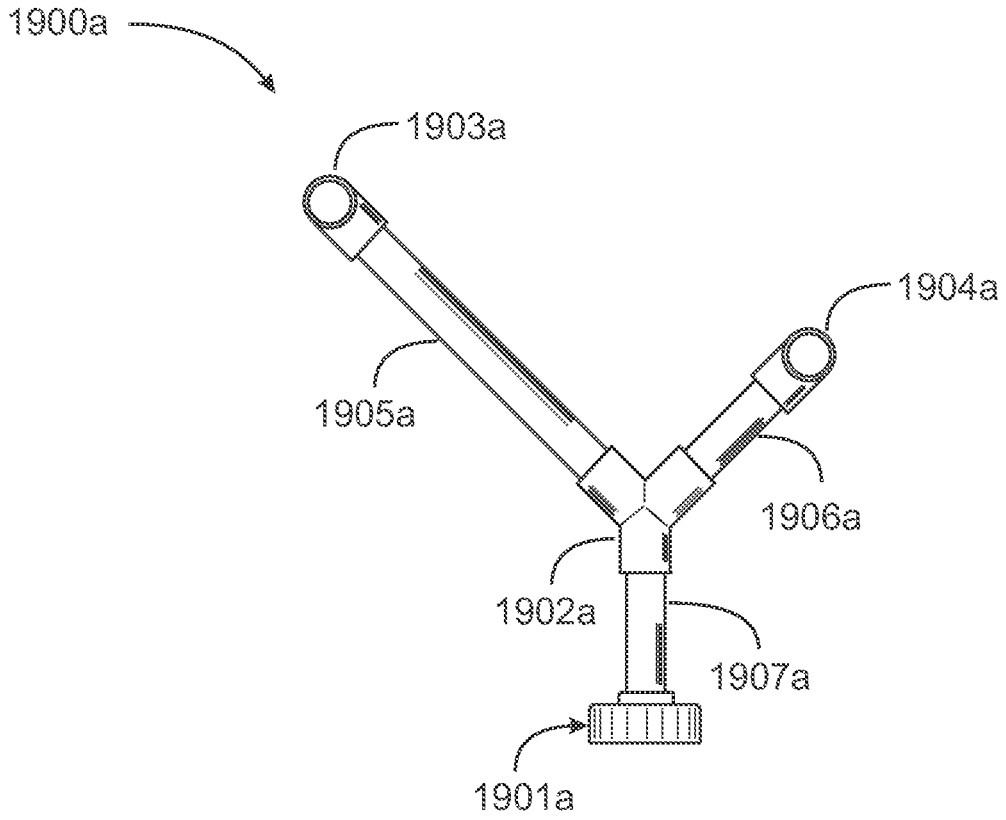
FIG. 19A is a side elevation view of a first portion of a shield framework in an embodiment of the invention.

FIG. 19A is a side elevation view of a first portion 1900 of a shield framework in an embodiment of the invention. Portion 1900 comprises two female halves of a plastic pipe union connector, adapted to connect first portion 1900 to support frame 1800 by male halves of universal 1808*a* and 1808*b* on support frame 1800. In the side view only one female portion of the union connector may be seen. Female half 1901*a* is fitted to a length of tubing 1907*a* which connects to a Y-connector 1902*a*. Y-connector 1902*a* connects in one branch to a tubing 1905*a* and on the other branch to a tubing 1906*a*, each of which tubes connect to a side outlet of a T-connector 1903*a* and 1904*a* respectively.

Figure 19B:
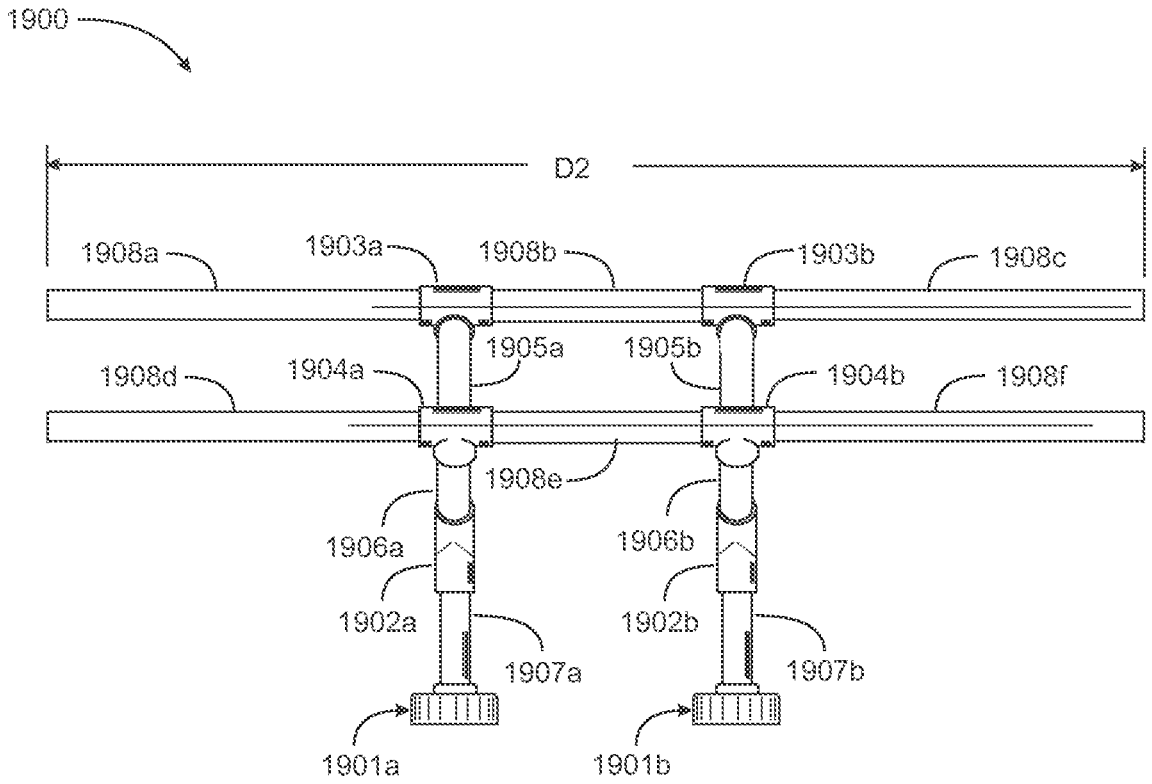
FIG. 19B is a rear elevation view of the first portion of the shield framework of FIG. 19A.

FIG. 19B is a rear elevation view of the shield framework portion 1900 of FIG. 19A, illustrating the framework portion with two widthwise tubing assemblies, an upper assembly comprising tubes 1908*a*, 1908*b* and 1908*c*, and a lower assembly comprising tubes 1908*d*, 1908*e* and 1908*f*, providing a shield framework of a width D2. D2 in this example is about 4 feet but may be more or less depending on circumstance. With assembly 1900 engaged to support frame 1800 (see FIG. 18), the upper reach of shield framework 1900 is in this example, between 12 inches and 16 inches above the top of the user's head.

Figure 20A:
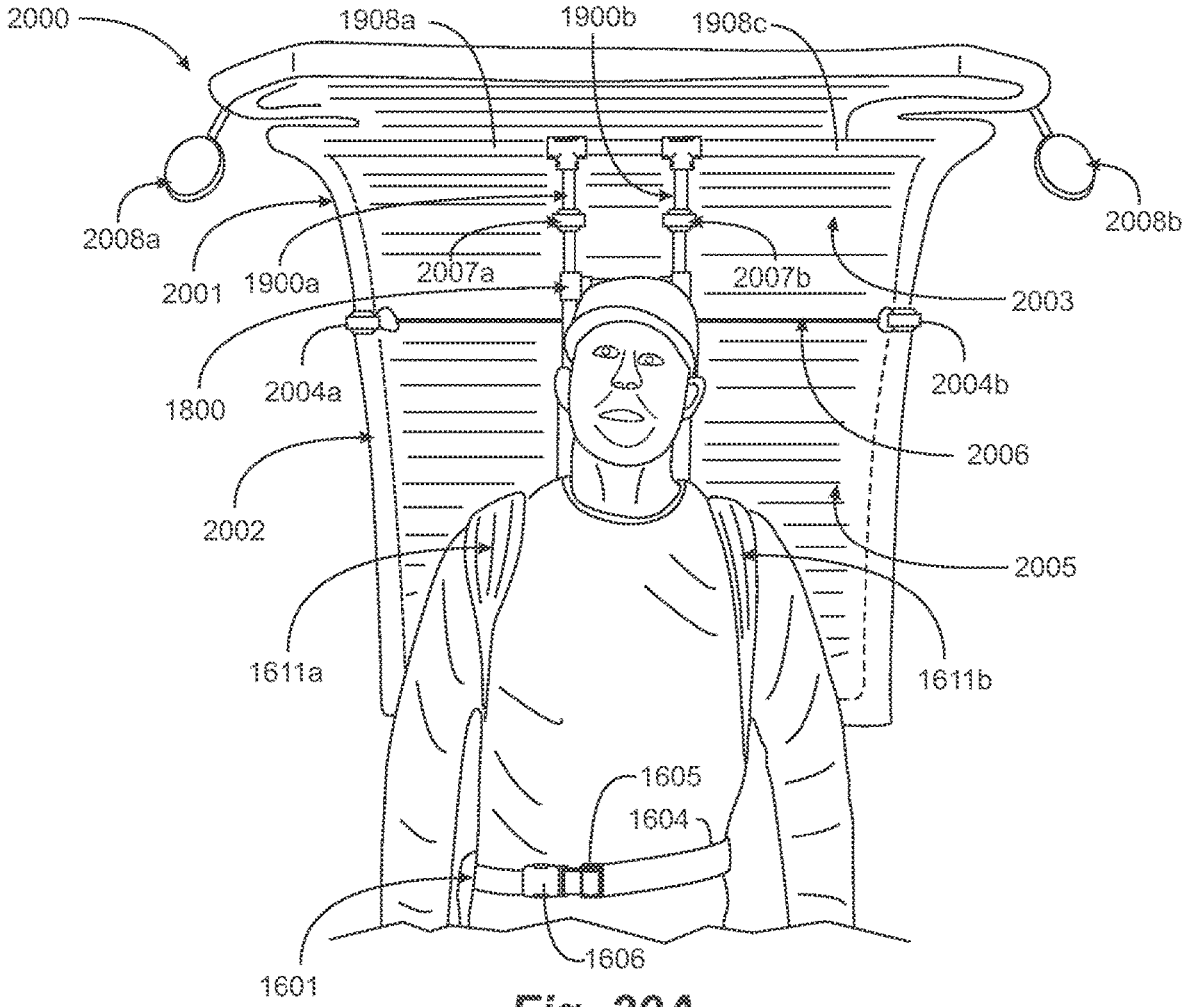
FIG. 20A is a front elevation view of a person wearing a full shield assembly according to an embodiment of the invention.

FIG. 20A is a front elevation view of a person wearing a full shield assembly 2000 according to an embodiment of the invention. The full shield assembly in this example has an upper shield assembly 2001 and a lower shield assembly 2002. A portion of shield holder 1601 may be seen secured to the waist area of the user by waist belt 1604 that is adjustable by adjustment buckle 1605 and secured by snap-in buckle 1606. An upper region of support frame 1800 may be seen behind the user extending above the user's head.

Upper shield assembly 2001 engages support frame 1800 by two union connectors at the upper extremity of support frame 1800, portions of which were called out above as 1808*a* and 1808*b* with reference to FIG. 18A, and as 1901*a* and 1901*b* with reference to FIG. 19B. The partial shield framework 1900 is a supporting portion of complete upper shield assembly 2001. The complete upper shield assembly 2001 is accomplished by adding tubing pieces and fittings from the ends of tubes 1908*a* and 1908*c* (FIG. 19B) to form an outer arcuate shape of shield assembly 2001, and covering the resulting outer tubing framework with sheet material 2003. Sheet material 2003 may be relatively thin and flexible plastic sheet material cut to shape and applied with tape to the outer boundary of the frame or may in some circumstances by fabric that may be applied with adhesive or with tape and may be painted with such as an epoxy material to provide water repellence and stiffness. The finished shield provides a barrier against both precipitation and sunlight, depending on circumstance.

In this example rear view mirrors 2008*a* and 2008*b* are provided attached to the upper shield assembly affording the user a view to the rear.

Lower shield assembly 2002 is fashioned, as is the upper shield assembly, of pieces of tubing coupled with fittings to provide a framework that is then covered with sheet material 2005, as described above for the upper shield assembly. Lower shield assembly 2002 is joined to upper shield assembly 2001, when desirable by the user, by connecting male a female portions of union connectors 2004*a* and 2004*b*, one portion of each union connector made a part of the framework of each of the upper and lower shield assemblies. The upper and lower shield assemblies separate along line 2006.

Upper shield assembly 2001 is mounted to support frame 1800 by two union connectors 2007*a* and 2007*b* which comprise halves 1808*a* and 1808*b* and 1901*a* and 1901*b* respectively. The female halves are part of the upper shield assembly, and the male halves are a part of the support frame 1800 respectfully.

Figure 20B:
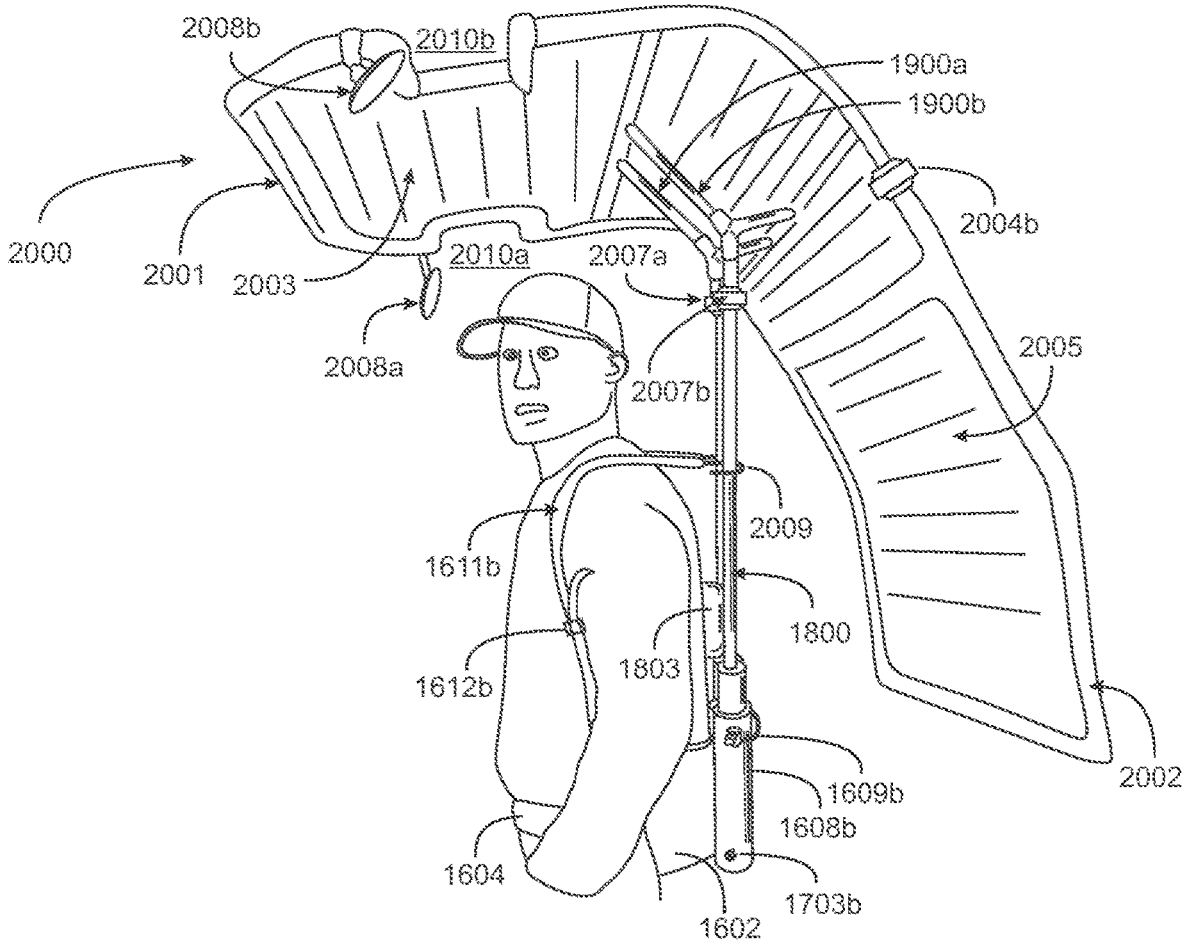
FIG. 20B is a side elevation view of the person wearing a full shield assembly according to an embodiment of the invention.

FIG. 20B is a side elevation view of full shield assembly 2000 of FIG. 20A in use. A portion of form 1602 of shield holder 1601 is illustrated secured to the user's body by waist belt 1604. One vertical tube 1608*b* of the two carrier tubes is seen attached to the rear of form 1602 and support frame 1800 is seen secured in the vertical tubes. Locking mechanism 1609*b* is illustrated. Bolts 1703*a* and 1703*b* constrain the support from in the vertical tube. Bolt 1703*b* may be seen in FIG. 20B.

Strap assembly 1611*b* is illustrated over the user's left shoulder attached to support frame 1800 by a hook 2009. The user is enabled to adjust length of strap 1611*b* to pull support frame forward urging cushion pad 1803 into the user's back, stabilizing the support frame to the user. Strap assembly 1611*a* is over the user's right shoulder, not seen in FIG. 20B, and hooks to support frame 1800 as well.

With support frame 1800 secured to the user, upper shield assembly 2001 is mounted to the support frame using union connectors 2007*a* and 2007*b*, providing a shield over the user's head area from precipitation and sunlight. In some user practice only the upper shield assembly may be used, such as in situations where rain is falling directly downward.

In some circumstances rain may be wind driven and additional protection may be needed. Sunlight at a steep angle may also be a problem. In such circumstances the lower shield assembly 2002 may be joined to the upper shield assembly by two union connectors 2004*a* and 2004*b*, of which 2004*b* is seen in FIG. 20B. Addition of the lower shield assembly provides additional protection. In some embodiments additional shield assemblies may be provided attachable to the upper and the lower shield assemblies shown, for protection in other, perhaps unusual, circumstances. In the instant example upper shield assembly 2001 is illustrated as having two notches 2010*a* and 2010*b* formed in the outer shape of the upper shield assembly. These notches are provided in the specific circumstance of a user performing traffic control in which a sign on a vertical shaft may be held to be displayed to motorists, such as STOP and SLOW. The notches enable a user to hold the shaft of the sign closer to the user's body and still have a wider upper shield for protection.

The skilled artisan will understand that all of the embodiments described above with reference to the drawing figures are exemplary only, and not limiting to the scope of the invention. The scope of the invention is limited only by the claims that follow.

The invention claimed is:

1. A weather shield apparatus, comprising:

a shield holder having a molded body panel with a curved shape providing ends joined to a lengthwise adjustable waist belt having a waist buckle;

a support interface attached to a rear surface of the body panel;

a support frame adapted to engage and extend upward from the support interface, the support frame having a cushion pad on a side facing the body panel; and a first weather shield assembly comprising a curved shield frame covered in waterproof sheet material, the curved shield frame having connector fittings projecting downward adapted to mate to compatible connector fittings at an uppermost extremity of the support frame;

characterized in that a user is enabled to mount the shield holder around the user's torso, fastened by the waist buckle of the waist belt, such that the support frame extends upward from behind the user with the cushion pad against the user's back, and supports the first weather shield assembly over the user's head, protecting the user from precipitation and sunlight while leaving the user's hands free.

2. The weather shield apparatus of claim 1 wherein the connector fittings are compatible portions of pipe union fittings.

3. The weather shield apparatus of claim 1 wherein the support interface is a set of two parallel, vertically-oriented tubes each of a first inside diameter, spaced apart by a center-to-center dimension D1 and open at top ends.

4. The weather shield apparatus of claim 3 wherein the support frame is a linear construction of tubes and fittings, having a lower end with two side-by-side tubes having each an outside diameter providing a slip fit to the inside diameter of the vertically-oriented tubes of the support interface, and spaced apart by center-to-center dimension D1, and an upper end with two side-by-side portions of connector fittings spaced apart by the center-to-center dimension D1.

5. The weather shield apparatus of claim 4 wherein the connector fittings are compatible portions of pipe union fittings.

6. The weather shield apparatus of claim 1 further comprising a first shoulder strap including a first adjustment buckle attached to one side of a front region of the molded body panel and ending in a first hook, and a second shoulder strap including a second adjustment buckle attached to an opposite side of the front region of the molded body panel and ending in a second hook, such that the user is enabled to pass the shoulder straps over the shoulders, hook each to a different portion of the support frame, and adjust length of the shoulder straps to pull the support frame with the cushion pad toward the user's back, stabilizing the support frame with the first weather shield assembly deployed over the user's head.

7. The weather shield apparatus of claim 1 wherein the first weather shield assembly curves downward to the rear with portions of a connector fitting on each side facing downward, the weather shield apparatus further comprising a substantially flat second weather shield assembly joined to the first weather shield assembly by compatible portions of connector fitting on each side of an upper end of the second weather shield assembly, such that the second weather shield assembly protects the user from precipitation and sunlight from the rear.

8. The weather shield apparatus of claim 7 wherein the connector fittings are compatible portions of pipe union fittings.

9. The weather shield apparatus of claim 1 wherein the first weather shield assembly further comprises a notch on each side over and to each side of the user's head, affording a space where the user may deploy a vertical pole of a sign while wearing the shield assembly.

10. The weather shield apparatus of claim 9 further comprising cushioning fabric implemented on an inside area and along edges of the molded body panel.

11. A method for protecting from precipitation and sunlight while leaving hands free, comprising:

implementing a weather shield apparatus with a shield holder having a molded body panel with a curved shape providing ends joined to a lengthwise adjustable waist belt having a waist buckle, a support interface attached to a rear surface of the body panel, a support frame adapted to engage and extend upward from the support interface, the support frame having a cushion pad on a side facing the body panel, and a first weather shield assembly comprising a curved shield frame covered in waterproof sheet material, the curved shield frame having connector fittings projecting downward adapted to mate to compatible connector fittings at an uppermost extremity of the support frame; and mounting the shield holder around the user's torso, fastened by the waist buckle of the waist belt, such that the support frame extends upward from behind the user with the cushion pad against the user's back, supporting the first weather shield assembly over the user's head, protecting the user from precipitation and sunlight while leaving the user's hands free.

12. The method of claim 11 comprising providing the connector fittings as compatible portions of pipe union fittings.

13. The method of claim 11 comprising providing the support interface as a set of two parallel, vertically-oriented tubes each of a first inside diameter, spaced apart by a center-to-center dimension D1 and open at top ends.

14. The method of claim 13 comprising providing the support frame as a linear construction of tubes and fittings, having a lower end with two side-by-side tubes having each an outside diameter providing a slip fit to the inside diameter of the vertically-oriented tubes of the support interface, and spaced apart by center-to-center dimension D1, and an upper end with two side-by-side portions of connector fittings spaced apart by the center-to-center dimension D1.

15. The method of claim 14 comprising providing the connector fittings as compatible portions of pipe union fittings.

16. The method of claim 11 further comprising providing a first shoulder strap including a first adjustment buckle attached to one side of a front region of the molded body panel and ending in a first hook, and a second shoulder strap including a second adjustment buckle attached to an opposite side of the front region of the molded body panel and ending in a second hook, such that the user is enabled to pass the shoulder straps over the shoulders, hook each to a different portion of the support frame, and adjust length of the shoulder straps to pull the support frame with the cushion pad toward the user's back, stabilizing the support frame with the first weather shield assembly deployed over the user's head.

17. The method of claim 11 comprising providing the first weather shield assembly as a shield that curves downward to the rear with portions of a connector fitting on each side facing downward, and providing a substantially flat second weather shield assembly joined to the first weather shield assembly by compatible portions of connector fitting on each side of an upper end of the second weather shield assembly, such that the second weather shield assembly protects the user from precipitation and sunlight from the rear.

18. The method of claim 17 comprising providing the connector fittings as compatible portions of pipe union fittings.

19. The method of claim 11 comprising providing a notch in the first weather shield assembly on each side over and to each side of the user's head, affording a space where the user may deploy a vertical pole of a sign while wearing the shield assembly.

20. The method of claim 19 further comprising placing cushioning fabric on an inside area and along edges of the molded body panel.

* * * * *